United States Patent [19]

Terio

[11] Patent Number: 4,780,020

[45] Date of Patent: Oct. 25, 1988

[54] TERRORIST VEHICLE BARRIER

[76] Inventor: Charles J. Terio, 1803 Paul Spring Parkway, Alexandria, Va. 22308

[21] Appl. No.: 82,582

[22] Filed: Aug. 7, 1987

[51] Int. Cl.[4] ..... E01F 13/00

[52] U.S. Cl. ..... 404/6; 49/9; 49/34

[58] Field of Search ..... 404/6, 9, 10; 49/9, 49/34, 49, 131, 133; 244/110 C; 256/1, 13.1; 188/371, 377

[56] References Cited

U.S. PATENT DOCUMENTS

| | | | |
|---|---|---|---|
| 4,007,917 | 2/1977 | Brubaker | 404/6 X |
| 4,047,702 | 9/1977 | Cernia et al. | 256/13.1 |
| 4,227,593 | 10/1980 | Bricmont et al. | 188/1 C |
| 4,576,507 | 3/1986 | Terio | 404/6 |

OTHER PUBLICATIONS

Unicel Corporation, Product Data ALH-SG/5052, Structural Grade Aluminum Honeycomb, Sep. 1986.

*Primary Examiner*—Stephen J. Novosad
*Assistant Examiner*—John F. Letchford
*Attorney, Agent, or Firm*—Fay, Sharpe, Beall, Fagan, Minnich & McKee

[57] ABSTRACT

A terrorist vehicle barrier is disclosed that is an improvement on the barrier shown in U.S. Pat. No. 4,576,507. The barrier consists of two vertical I-beams having cable passed between them to provide a barrier. An expanded aluminum honeycomb is provided between the I-beam and the cable passing around the I-beam to provide an effective shock absorbing structure. The barrier can be employed as an actuatable gate or as a fence-like structure around the perimeter of a installation to provide an esthetic and cost effective barrier strong enough to stop a high speed vehicle with minimum damage to the barrier.

20 Claims, 4 Drawing Sheets

TERRORIST VEHICLE BARRIER

BACKGROUND OF THE INVENTION

In recent years terrorist activity has greatly increased. Particularly popular among terrorists is the technique of loading a vehicle with explosives and driving the vehicle at high speed into a building or installation to blow it up and, at the same time, kill as many people as possible. Attempts to thwart such terrorist activities have included the erection of concrete barriers around buildings, the use of around-the-clock security personnel, etc. The recent success of terrorists indicates that these techniques are ineffective.

Concrete barriers are objected to because of their esthetically unpleasing character. Most buildings that are the object of terrorist attack are designed to be pleasing to the eye and the erection of concrete barriers around such buildings destroys their esthetic character. These facts lead me to design the terrorist vehicle barrier described in U.S. Pat. No. 4,576,507, the specification and drawings of which are incorporated herein by reference. To briefly summarize this prior vehicle barrier, two vertically disposed I-beams have mounted therein conventional telescoping shock absorbers around which are wrapped cables which lie in the path of a terrorist vehicle. The cables and shock absorbers absorb the impact of the vehicle with a minimum of damage to the barrier itself.

SUMMARY OF THE INVENTION

The present invention provides a novel shock absorbing arrangement for a cable-type vehicle arresting structure.

It is an object of the invention to provide a shock absorbing structure for a vehicle barrier capable of stopping a high speed, heavily loaded vehicle in its tracks, unlike many prior barriers which allow a major portion of the speeding vehicle to pass over or through the barrier a significant distance beyond the barrier to eventually contact the structure to be protected.

It is a further object to the invention to provide a vehicle barrier that is easier to assemble, cheaper to maintain and far easier to repair after impact than prior art barriers because of the simple and effective shock absorbing structure employed.

The present shock absorbing arrangement employs an expanded aluminum honeycomb to provide an improved shock absorbing function in a vehicle barrier of the type disclosed in U.S. Pat. No. 4,576,507.

As will be described in detail below, this shock absorbing arrangement provides a very effective barrier for stopping a high speed vehicle.

DETAILED DESCRIPTION OF THE PREFERRED EMBODIMENT

Figure 1:
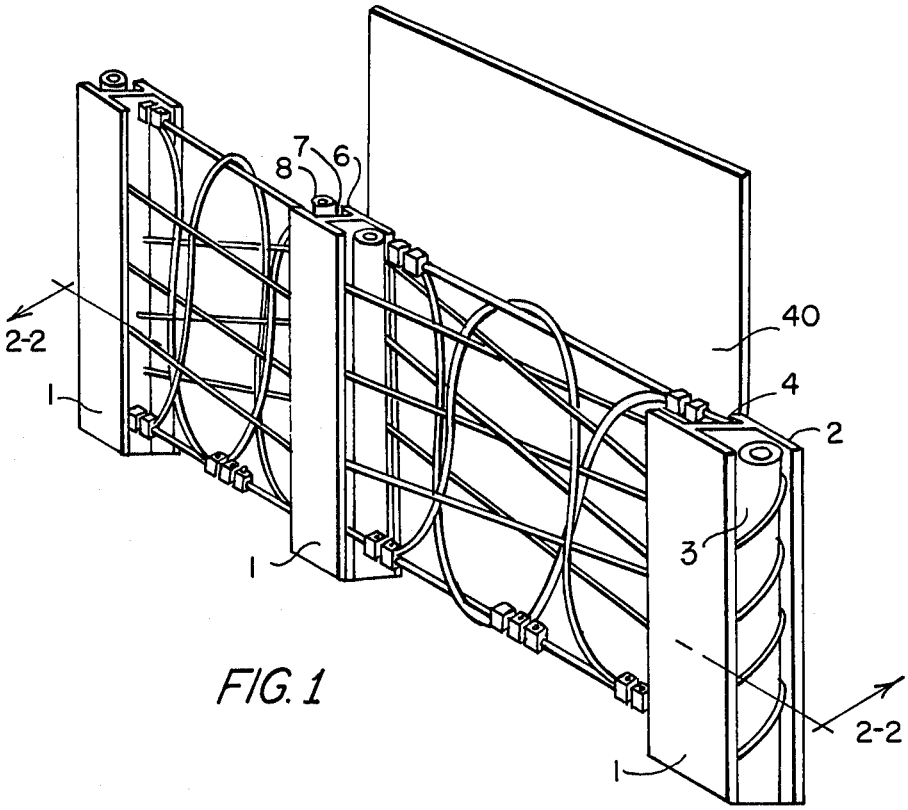
FIG. 1 is a perspective view of the vehicle barrier of the present invention.

FIG. 1 shows the most general arrangement contemplated for the present invention. I-beams 1 are placed in a vertical orientation and can be either fixed in the ground or movable from a hidden position, for example, as shown in FIG. 1 of previously mentioned U.S. Pat. No. 4,576,507.

Figure 2:
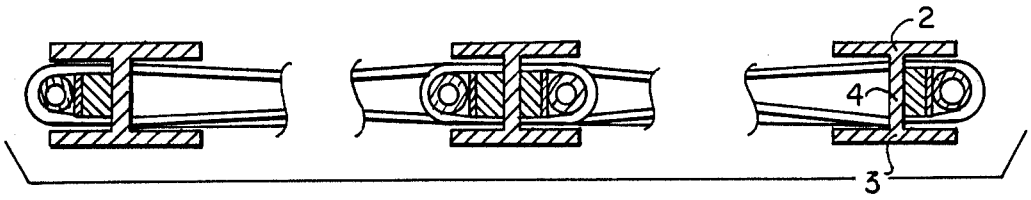
FIG. 2 is a section along line 2—2 of FIG. 1.

The I-beams 1 are comprised of two parallel webs 2 and 3 joined at their midlines by a perpendicular web 4. As can be seen in FIG. 2, which is a section through FIG. 1 along line 2—2, a plurality of I-beams 2 can be lined up around the perimeter of any particular installation to provide a fence-like structure. However, only two I-beams are required to form an effective barrier in a relatively narrow space of approximately 10–20 feet wide as shown in FIG. 3.

Figure 3:
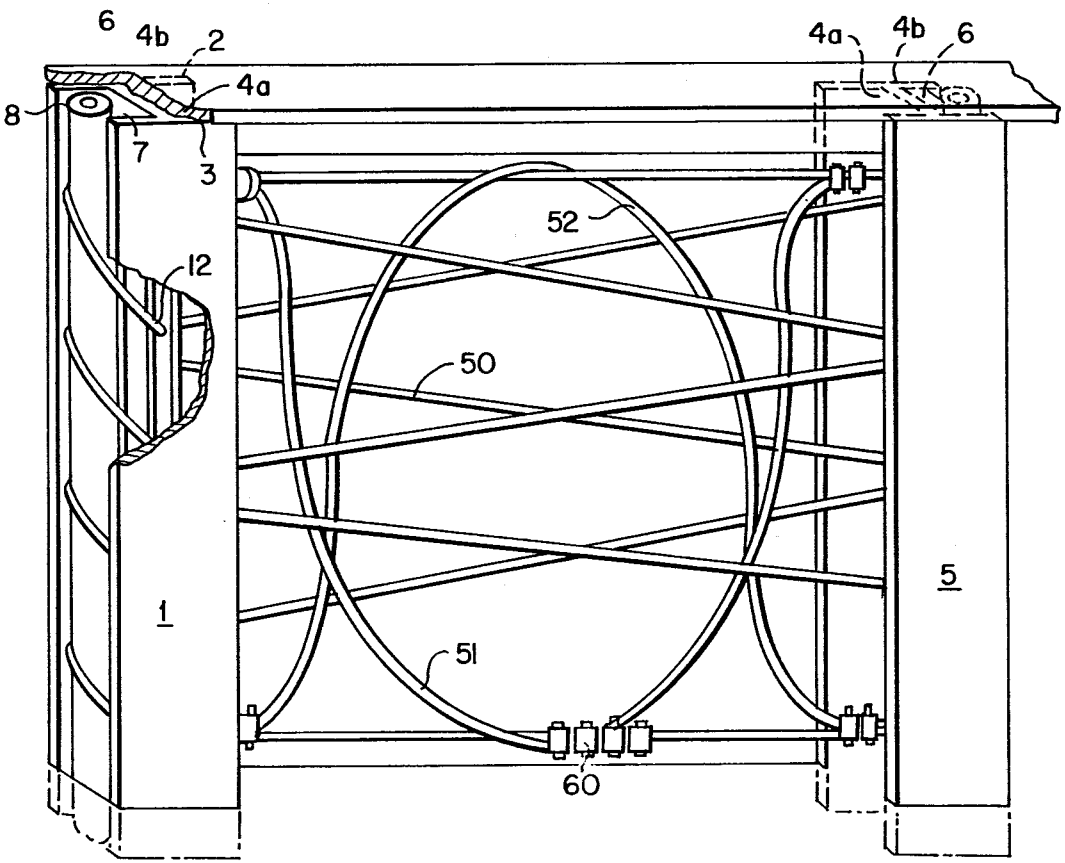
FIG. 3 is a perspective view partly in section of the preferred embodiment of the present invention.

The barrier of FIG. 3 employs two I-beams 1 and 5 having their central webs 4 substantially parallel to each other. The phrase "substantially parallel" is to be interpreted as encompassing the orientation of beams where they are slightly rotated from the position shown in FIG. 3 to a position such as is shown in U.S. Pat. No. 4,576,507, FIG. 5. The webs 4 have an inner face **4*a* and an outer face 4*b***. The inner faces of a pair of adjacent I-beams are those faces that face each other. The outer faces are those faces which are opposite the inner faces.

Figure 11:
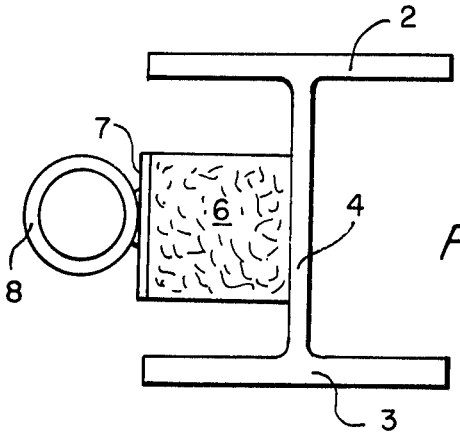
FIG. 11 is a horizontal section similar to FIG. 5.

As shown in FIGS. 3 and 11, mounted on each outer face is a block of crushable aluminum honeycomb shock absorbing material 6 (described later), a plate 7 on the outer face of the honeycomb material and a pipe 8 resting on the plate 7. The central web 4 of each I-beam has spaced holes 12 (numbered 71 through 88) shown in FIG. 4. These holes lie near both edges of the central web 4 in vertical columns near the midlines of webs 2 and 3 where the central web joins the two parallel outer webs 2 and 3. These holes allow the cable to pass through the central web, around a shock absorbing structure composed of members 6, 7 and 8 and back through the central web to continue a wrapping sequence, described later, that provides an effective barrier.

As shown in FIGS. 1 and 3, a single strand of cable is employed that is wrapped around the vertical uprights several times to provide a barrier effective in stopping a high speed vehicle. The wrapping pattern employed can be adjusted to suit the requirements of the barrier but it is best to have the cable passed through the central web of the I-beam at one vertical location, wrap around the shock absorbing structure and pass through the central web again at a point either well above or well below the spot where it initially passed through the central web and in the other vertical column of holes.

Figure 4:
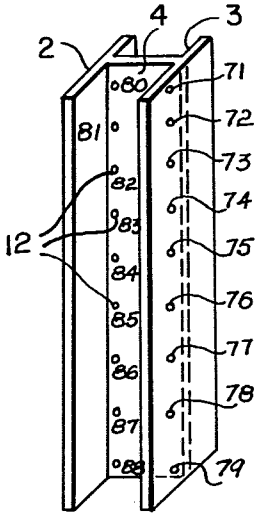
FIG. 4 is a perspective view of one of the vertical I-beams showing cable hole locations.

This provides for maximum contact of cable with the shock absorbing assembly. As best shown in FIGS. 3 and 4, the cable enters through a hole in the first vertical column of holes near the top of the I-beam, wraps around the shock absorbing structure made up of members 6, 7 and 8 and passes again through the central web through hole 12 in the second vertical column of holes a substantial vertical distance below where it entered the first column of holes. This provides a relatively long length of cable in contact with pipe 6 to more effectively transfer the shock of a vehicle hitting the cable to the shock absorbing material. Although FIG. 3 shows the perferred embodiment, the shock absorbing material behaves in such a manner that pipe 8 and plate 7 may not be needed.

The preferred wrapping pattern shown in FIG. 3 can best be described with reference to FIG. 4. Each vertical I-beam has two vertical columns of holes very near the two edges of central web 4 near where they join with the mid lines of the two parallel webs 2 and 3. The first vertical column has holes numbered 71–79, the second vertical column has holes numbered 80–88. If we consider the side of web 4 facing the viewer as the outside face then the wrapping pattern can be described as follows: the cable end enters hole 71 from the inside face and passes through to the outside face, wraps around the shock absorbing material (not shown) passes back through central web 4 through hole 82 where it proceeds over to the adjacent I-beam (not shown). The other cable end passes through a hole 71 on the adjacent I-beam (not shown) around the shock absorbing material, and through corresponding hole 82. The end of the cable is brought across the space between the vertical uprights and passes through hole 72 from the inside, around the shock absorbing material, and through hole 83 and subsequently passed over to the adjacent I-beam. This pattern is repeated until the three crossed cables are formed as shown in FIGS. 1 and 3 and until the cable passes through hole 88 on both I-beams to be joined in the middle to form a continuous loop around the adjacent I-beams as shown in FIGS. 1 and 3. Suitable cable clamps are employed to join the cable ends.

When the I-beams are arranged in the fence-like manner shown in FIG. 1 it is apparent that the center I-beam provides for mounting two shock absorbing arrangements to interact with an I-beam on each side. FIG. 2 shows this arrangement quite clearly. Obviously, the I-beams on either end require only one shock absorbing arrangement on their outside faces whereas any interior I-beams would require two shock absorbing arrangements, one on each face of the central web. If a circular or other closed perimeter were to be provided, then all I-beams would have two shock-absorbing arrangements, one on each face of the central web 4.

Figure 5:
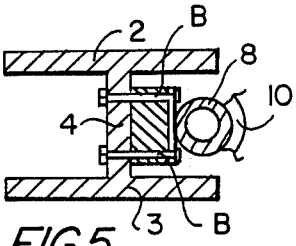
FIG. 5 is a horizontal section through a vertical I-beam showing bolts passing through the shock absorbing material.

As shown in FIG. 5, it might be desirable to bolt the shock absorbing assembly made up of honeycomb 6, plate 7, and pipe 8 to the central web 4 of the I-beams so that the cable can be wrapped easily. However, the bolts perform no shock absorbing function when the gate is in use so they can be eliminated.

Figure 6:
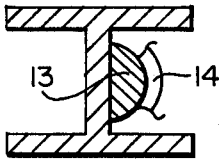
FIG. 6 is a horizontal section through one of the I-beams showing an alternative embodiment for the shape of the shock absorbing material.

FIG. 6 shows a half-round form of the shock absorbing material 13 with a half-round metal covering 14 that accomplishes the same function as pipe 8 and plate 7 of FIGS. 1–5.

Figure 12:
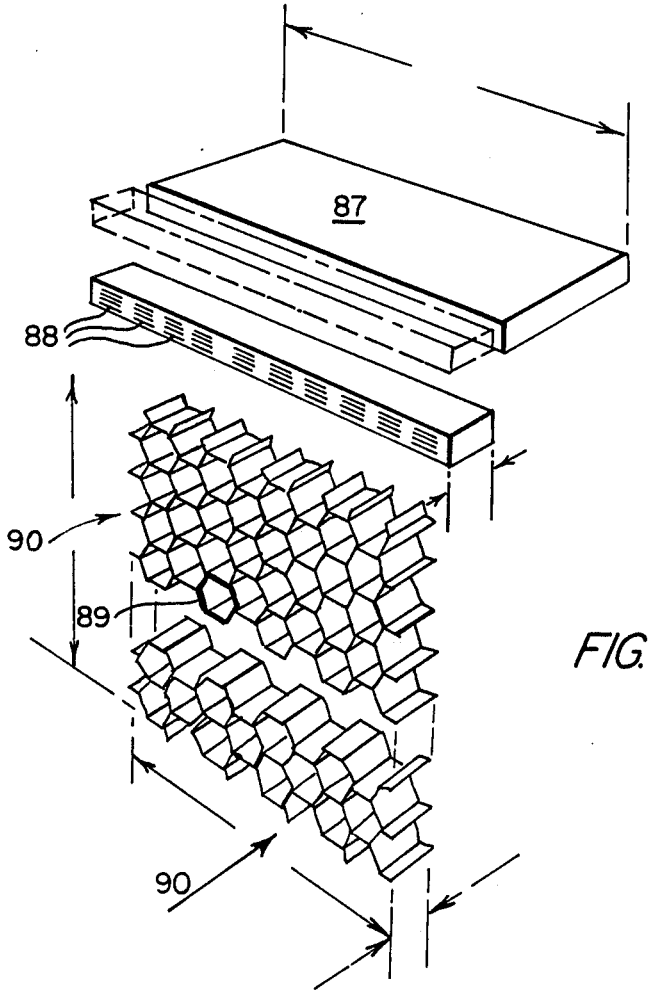
FIG. 12 details a method of making expanded metal honeycomb.

In all embodiments, the aluminum honeycomb material can be of the type known as Unicel® ALH-SG available from Unicel Corporation, 1602 Robin Circle, Forest Hill, MD 21050 and shown in FIG. 12. This structural-grade aluminum honeycomb can be manufactured in any size or strength-to-weight ratio as the application requires. The size of the individual cells shown in FIG. 12 as well as the sheet thickness and width determines the strength of the honeycomb. It is envisioned that the honeycomb could be cut to sizes such that it is placed only where the cable wraps around the I-beam in order to use less of the honeycomb material. It can be cut to any shape or size with relative ease.

FIG. 12 details the exact structure of the crushable honeycomb material. Several sheets 87 of aluminum foil are glued along specific lines 88 that join the foils only along these specific lines. The laminated foil block can then be cut to size and expanded to form a honeycomb panel. The present invention employs the honeycomb material in its final form so the manner in which it is made is irrelevant. FIG. 12 is included only in the interest of an enabling disclosure since, as far as applicant is aware, this honeycomb has never been used as a shock absorbing material in the manner disclosed herein.

Any impact on the cables between two adjacent I-beams will impose a crushing force acting on the thickness dimension of the honeycomb. Each of the plural webs of the honeycomb will collapse slightly under this force to effectively absorb the impact by virtue of the great number of honeycomb webs present. This honeycomb exhibits a uniform energy absorbing characteristic when mechanical forces are applied to the columnar ends 89 of the honeycomb cells along force lines 90. The resulting structure presents plural hollow, multisided, parallel cells. The application of mechanical forces to the columnar end of the cells causes the cell walls to fold into small accordian-like pleats resulting in compression of the structure and adsorption of energy.

Another characteristic of honeycomb is that its compression or columnar strength is considerably greater than its uniform crush strength. For this reason extremely high initial peak loads are required to initiate buckling of the cell walls. See U.S. Pat. No. 4,227,593 for a further discussion of the properties of honeycomb material.

Figure 7:
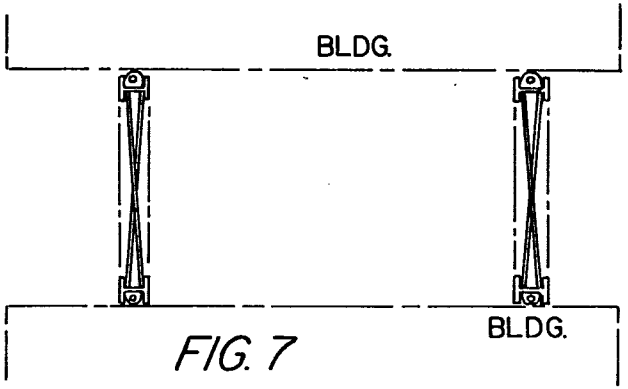
FIG. 7 is a top view of two gates spaced apart between two building structures.

FIG. 7 shows an arrangement of two vehicle barriers employed longitudinally spaced between two buildings. In some instances it may be desired to trap a vehicle between two vehicle barriers of the actuatable type employing the shock absorbing structure of the present invention with the actuating feature of the gate shown in U.S. Pat. No. 4,576,507, such as when a vehicle is trying to leave an installation with stolen weapons.

Figure 8:
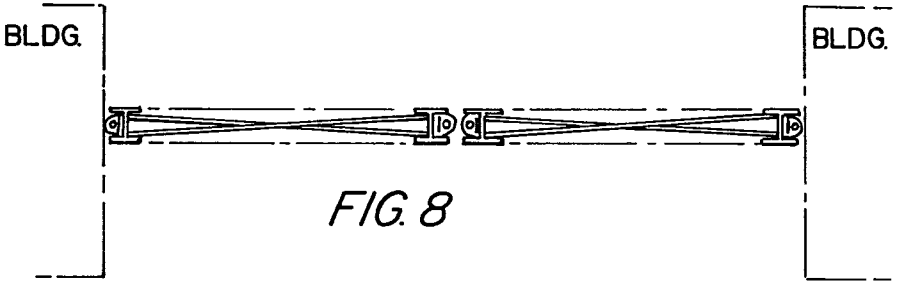
FIG. 8 is a top view of two laterally spaced vehicle barriers protecting a wide space between two building structures.

FIG. 8 shows two laterally spaced barriers for blocking off a relatively wide opening. The width of each individual gate is limited by the size and strength of the I-beam and the cable wrapping technique employed. Therefore, a wide opening could be closed by a series of actuatable gates.

Figure 10:
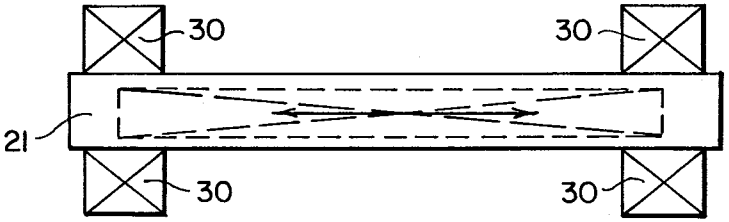
FIG. 10 is a top view of FIG. 9.
Figure 9:
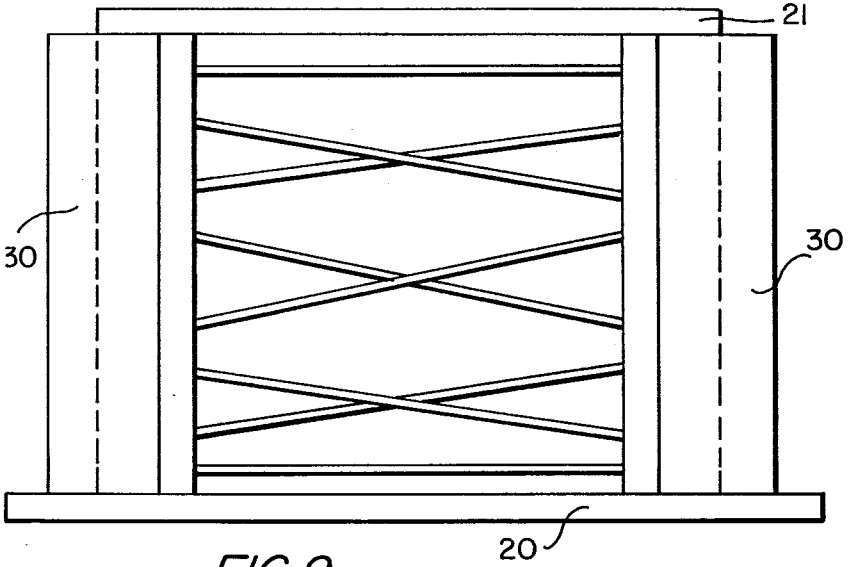
FIG. 9 is a front elevational view of a sliding version of the present invention.

FIGS. 9 and 10 show a sliding version of the vehicle barrier. The I-beams are connected at their top and bottom by horizontal plates 20 and 21 to provide a rigid gate that can be slid across an opening. Support members 30 support the barrier from either direction to provide effective protection.

It is an important point to note that any of the barriers disclosed in the present application will work from either direction, i.e. a high speed vehicle either entering or leaving an installation can be stopped. This is not true for most prior barriers.

In order that the barrier be more esthetically pleasing it would be possible to slide a decorative panel into position between adjacent I-beams as shown in FIG. 1. Panel 40 would not only make the gate more pleasing to look at but would hide the functioning components of the barrier from view to protect them from weather and from scrutiny by potential terrorists. Two such panels would be employed between each pair of I-beams, one in front of the cables, one in back, between the cables and webs 2 and 3, respectively.

An important advantage of the present design is the relatively easy repairability of the gate should it be impacted by a high speed vehicle. During tests of the gate it was found that only the shock absorbing material and the cable were damaged by a high speed impact. The I-beams returned easily to their below ground position after the vehicle debris was cleared, the old cables and shock absorbing material removed, and new cables and shock absorbing material put in place. This is an important maintenance feature although it is hoped that any antiterrorist barrier will never be used for its intended purpose. Prior gates and barriers can be completely destroyed upon impact by a heavy speeding vehicle and must be entirely replaced.

Also, the barrier of the present invention can sit unattended for years and still perform its intended function since none of the parts will significantly deteriorate.

While I-beams are disclosed as the preferred embodiment, any vertical upright of sufficient strength and having a surface suitable for mounting the shock absorbing arrangement could be used.

Also, the cables can be steel cables, fabric cables, or any high strength material capable of performing the intended function.

FIG. 3 shows a preferred cable wrapping arrangement. Three pieces of cable are employed. One continuous strand 50 wraps around each I-beam and shock absorbing arrangement several times to provide, in effect, a single top and bottom horizontal strand and three pairs of crossed strands between the upper and lower horizontal strands. Second strand 51 is attached to the top strand, passed down through the crossed strands and around the bottom strand, then up through the cross strands to again attach to the top strand. A third strand 52 is attached to the bottom strand passed up through the cross strand, around the top strand, and back down through the crossed strands to attach again to the lower horizontal strand. The ends of these strands 51 and 52 are clamped by cable clamps to their respective upper and lower horizontal strands. Also, the long single strand is clamped together where it joins itself at the bottom by clamps 60. Once again, FIG. 3 shows a preferred cable wrapping pattern. The actual pattern of cable wrapping may vary provided the pattern is sufficient to stop a high speed, heavy vehicle. We have found the pattern disclosed in FIG. 3 to be most effective.

The shock absorbing structure described above can be employed in most any barrier where cables are used. Applications include railroad crossings and drawbridges, airplane barriers at the end of runways or on aircraft carriers, or safety rails on roadways etc. The embodiments detailed here are merely the preferred embodiments. The invention is limited only by the appended claims.

I claim:

1. A vehicle barrier comprising:

at least two upright supports, cable means passing around at least a portion of each said upright, said cable means providing a barrier between said uprights, shock absorbing means mounted between said cable means and said portions of said uprights where said cable means passes around said uprights, said shock absorbing means comprising a crushable block of shock absorbing material, and force distributing means positioned between said cable and said shock absorbing material to better distribute the force of the cable over the area of the shock absorbing material upon impact by a vehicle.

2. The vehicle barrier of claim 1, wherein said crushable block is metal honeycomb.

3. The vehicle barrier of claim 1, wherein said crushable block is expanded metal honeycomb.

4. The vehicle barrier according to claim 1, wherein said force distributing means is a vertically disposed pipe.

5. The vehicle barrier according to claim 4, wherein a flat metal plate is provided between said vertically disposed pipe and said shock absorbing material.

6. The vehicle barrier according to claim 1, wherein said at least two uprights are part of a laterally sliding gate positionable in the path of a vehicle.

7. The vehicle barrier of claim 1, wherein said at least two uprights are I-beams, each I-beam comprising two parallel webs joined at their midlines by a perpendicular central web, said central webs having inside and outside faces defined by the relative position of adjacent I-beams, said inside faces of said central webs of adjacent I-beams facing each other, said outside faces opposite said inside faces, each of said central webs having first and second columns of vertically spaced holes, one column along each edge of said central web near its junction with the said parallel webs, said holes allowing said cable means to pass through said central web, said shock absorbing material positioned on each said outside face of each said central web between said first and second columns of vertically spaced holes, said cable means comprising a strand having two ends, one end passing through said central web from the inside face of one of said I-beams via a first hole in said first column of holes, around said shock absorbing material, and back through said central web from the outside face thereof through a second hole in said second column of holes, the other end of said cable passing through said central web of an adjacent I-beam from its inside face via a first hole in one of said first column of holes on said adjacent I-beam, around said shock absorbing material, and back through said central web of said adjacent I-beam from its outside face through a second hole in said second column of holes, said cable ends joined together between said I-beams to form a closed loop around said I-beams, said loop lying in the path of a vehicle.

8. The vehicle barrier of claim 7, wherein said crushable block is metal honeycomb.

9. The vehicle barrier of claim 7, wherein said crushable block is expanded metal honeycomb.

10. The vehicle barrier of claim 7, wherein said force distributing means is a vertically disposed pipe.

11. The vehicle barrier according to claim 10, wherein a metal plate is provided between said pipe and said shock absorbing material.

12. The vehicle barrier according to claim 7, wherein said at least two uprights are part of a laterally sliding gate positionable in the path of a vehicle.

13. The vehicle barrier according to claim 7, wherein said cable means is wrapped around pairs of adjacent I-beams in a pattern such that one said end passes through said central web of one I-beam of an adjacent pair of I-beams from the inside face thereof via a first hole in said first column of holes, around said shock absorbing material, and back through said central web from the outside face thereof via a second hole in said second column of holes, the other said end passes through said central web of the other I-beam of said adjacent pair of I-beams from the inside face thereof via a first hole in said first column of holes of said other I-beam, around said shock absorbing material, and back through said central web in the outside face thereof via a second hole in said second column of holes, said pattern repeated a plurality of times at different vertical locations on said central webs before joining itself to provide several portions of said cable at different vertical heights across said vehicle path.

14. The vehicle barrier according to claim 13, wherein said first holes are the uppermost used holes on said I-beams, said second holes are vertically below said first holes and wherein each repeated pattern is vertically below the preceeding one.

15. The vehicle barrier according to claim 13, wherein said first holes are the lowermost used holes on said I-beams, said second holes are vertically above said first holes and wherein each repeated pattern is vertically above the preceeding one.

16. The vehicle barrier of claim 13, wherein said crushable block is metal honeycomb.

17. The vehicle barrier of claim 15 wherein said crushable block is expanded metal honeycomb.

18. The vehicle barrier according to claim 13, wherein said force distributing means is a vertically disposed pipe.

19. The vehicle barrier according to claim 18, wherein a metal plate is provided between said pipe and said shock absorbing material.

20. The vehicle barrier according to claim 13, wherein said at least two uprights are part of a laterally sliding gate positionable in the path of a vehicle.

* * * * *